US010317155B2

(12) United States Patent
Adamietz, Jr.

(10) Patent No.: US 10,317,155 B2
(45) Date of Patent: Jun. 11, 2019

(54) 1911 BUSHING WRENCH AND RECOIL SPRING PLUG CATCHER

(71) Applicant: Gerald Adamietz, Jr., Spokane, WA (US)

(72) Inventor: Gerald Adamietz, Jr., Spokane, WA (US)

( * ) Notice: Subject to any disclaimer, the term of this patent is extended or adjusted under 35 U.S.C. 154(b) by 538 days.

(21) Appl. No.: 14/611,406

(22) Filed: Mar. 27, 2015

(65) Prior Publication Data

US 2016/0282072 A1 Sep. 29, 2016

(51) Int. Cl.
*F41A 11/00* (2006.01)
*F41C 27/00* (2006.01)

(52) U.S. Cl.
CPC ..... *F41A 11/00* (2013.01); *F41C 27/00* (2013.01)

(58) Field of Classification Search
None
See application file for complete search history.

(56) References Cited

U.S. PATENT DOCUMENTS

D210,093 S 2/1968 Bliss
4,901,411 A * 2/1990 Chestnut ..... B25B 13/48 42/108
4,961,239 A 10/1990 Boyd, Sr. et al.
D407,958 S 4/1999 Royse, III
7,174,667 B2 2/2007 Connal
7,401,432 B2 7/2008 Perry
7,703,232 B1 4/2010 Johns
8,800,193 B1 * 8/2014 Frear, Jr. ..... F41A 11/00 42/108
2005/0247170 A1 * 11/2005 Chen ..... B25G 1/08 81/490
2006/0162224 A1 * 7/2006 Connal ..... F41A 35/00 42/108
2006/0260170 A1 * 11/2006 Perry ..... F41A 11/00 42/108
2010/0095576 A1 * 4/2010 Johns ..... F41A 21/00 42/108
2011/0192260 A1 * 8/2011 Hsieh ..... B25B 13/04 81/177.1
2014/0290112 A1 10/2014 Horne
2015/0020428 A1 * 1/2015 Jenkinson ..... F41A 35/00 42/108

* cited by examiner

*Primary Examiner* — Charlie Y Peng
(74) *Attorney, Agent, or Firm* — Wells St. John P.S.

(57) ABSTRACT

A firearm tool is provided that can include: an elongate member extending from a first end to a second end and defining opposing planar surfaces; at least two openings defined about the first end of the elongate member and extending between the opposing planar surfaces; one of the two openings configured to engage a bushing; another of the two openings configured to receive a recoil spring; and wherein the at least two openings overlap.

9 Claims, 1 Drawing Sheet

1911 BUSHING WRENCH AND RECOIL SPRING PLUG CATCHER

TECHNICAL FIELD

The present invention relates to an improved tool for assisting in the dis-assembly and reassembly of a firearm; particularly 1911 pattern automatic pistols reducing potential injury and damage from accidental release of the recoil spring plug/guide rod plug, which us under considerable spring pressure.

BACKGROUND OF THE INVENTION

The Colt Model 1911 was designed by John Browning, designer of various modern firearms. In 1906 the US Military, under the direction of General William Crozier of the Ordinance Department, began evaluating several pistol designs along with the suitability of a new cartridge that was designated the .45 Automatic Colt Pistol (or .45 ACP for short). As these military tests continued over the next several years, the John Browning designed pistol began to emerge as the clear favorite.

In March 1911, the Browning-designed .45 automatic pistol, manufactured by Colt was selected as the official sidearm of the armed forces of the United States of America and was designated the Model 1911. Because of its speed, reliability and distinguished history, the 1911 firearm is still popular today with gun enthusiasts and collectors. Various models of the 1911 have been produced by virtually all firearm manufacturers.

To disassemble the 1911 to clean or repair the firearm, the procedure for various manufacturers is basically the same. The procedure involves the rotation and removal of the barrel bushing and the recoil spring plug/guide rod plug. Rotation and dis assembly of these parts can be accomplished by hand without the use of any tools. However, such procedure may be difficult and awkward as a normal procedure is to depress the recoil spring plug and at the same time rotate the barrel bushing by approximately ¼ turn. After barrel bushing has been rotated, the barrel bushing and the recoil spring plug/guide rod plug can be removed. The too less procedure may be difficult because of the necessity to depress the recoil spring plug as it is under spring pressure and rotate the barrel at the same time. The recoil spring plug/guide rod plug can slip off the thumb launch the plug as a projectile—injuring the person, other persons nearby or causing damage to nearby objects. Therefore, a tool is recommended to assist the user when rotation of the barrel bushing and removing the spring plug. The tool, called a "barrel bushing wrench," is a wrench having an aperture generally in the shape of the barrel bushing that is fitted on the barrel bushing and turned to rotate the barrel bushing. However, there is still no provision to secure the recoil spring plug/guide rod plug on these tools.

The prior art discloses several other types of tools for this purpose. U.S. Design Pat. No. 407958 shows a lockout, safety and bushing removal tool for an automatic handgun.

U.S. Pat. No. 4,901,411 discloses a tool for rotating a barrel bushing or spring plug in a 45 caliber pistol. The tool has a flange to prevent the uncontrolled ejection of the plug and spring. The tool includes a recess for partially receiving the ejected plug. Studs are positioned to control the amount and/or direction of rotation of the bushing or plug.

U.S. Pat. No. 7,174,667 B2 also discloses a tool for rotating a barrel bushing or spring plug on a 1911 45 caliber pistol. A tool to facilitate the removal of a barrel bushing on a handgun such as the 1911 automatic pistol. The tool has a handle which fold-able receives a wrench having an aperture conforming to the shape of bushing. In the extended position, the wrench is provided with ridges or serrations to friction-ally engage the fingers or hands of the user.

While tools, as described above, are suitable for the intended purpose, they generally are single purpose tools not having the capability to disassemble other parts of the pistol, nor do they have a provision for the secure reassembly of the spring recoil plug/guide rod plug—barrel bushing assembly.

Accordingly, there exists a need for a multi-tool which can which can disassemble and reassemble a 1911 pistol safely and easily for the end user.

The invention disclosed here positively retrieves the recoil spring plug at the precise time the barrel bushing loses contact with and releases the recoil spring plug/guide rod plug.

BRIEF SUMMARY OF THE INVENTION

The present invention consists of a multi-tool having a flat handle with its barrel bushing aperture combined with its recoil plug catcher/installer on one end a ¼ inch hex insert on the other end to accommodate various ¼ inch hex tool bits.

The wrench is made of suitable strength material such as a high density polymer plastic. The wrench defines an opening conforming to the shape of the barrel bushing and recoil spring plug. The lower end of the wrench is generally rounded with a ¼ inch hex bit insert.

The present disclosure also provides a firearm tool that includes: an elongate member extending from a first end to a second end and defining opposing planar surfaces; at least two openings defined about the first end of the elongate member and extending between the opposing planar surfaces; one of the two openings configured to engage a bushing; another of the two openings configured to receive a recoil spring; and wherein the at least two openings overlap.

BRIEF DESCRIPTION OF THE DRAWINGS

The above and other advantages and objects of the present invention will become more apparent from the following description, claims and drawings:

DESCRIPTION

Figure 3B:
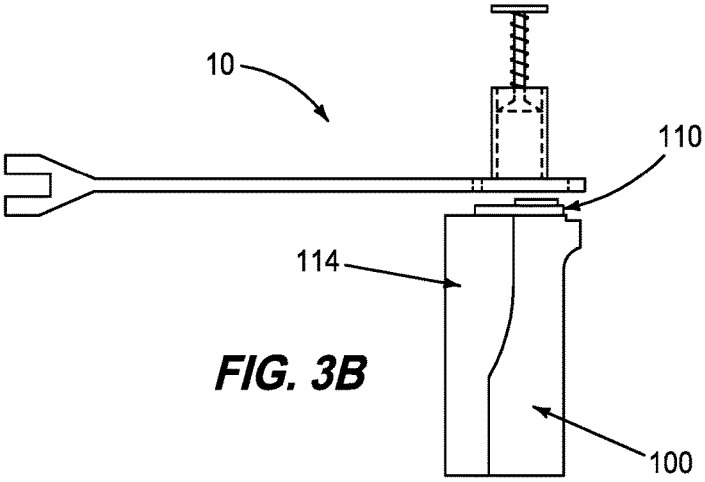
FIG. 3B is a depiction of the firearm tool of FIGS. 1 and 2 set to engage the portion of the firearm of FIG. 3A.

A tool to facilitate the removal of a barrel bushing and recoil spring plug/guide rod plug and re-install them on (Model) M1911 type self loading, magazine fed pistols (hereafter referred to as "1911").

This invention relates to an improved 1911 barrel bushing wrench. The object of this invention to provide a recoil spring plug/guide rod plug catcher and ¼ inch hex insert socket on the heel of the tool to accommodate screwdrivers, pin removers and other ¼ inch hex tool bits. The recoil spring plug/guide rod plug catcher allows the user to easily contain the spring loaded recoil spring plug/guide rod plug without accidental launching the plug, which, upon striking a person or object can cause injury or damage. The tool also allows the user to safely and easily re-install the recoil spring plug/guide rod plug back into the pistol with the spring loaded thumb plunger. The ¼ inch hex insert socket on the heel of the tool along with the necessary accessory bits allows the user to to have just one tool in order to further disassemble the 1911 pistol.

Turning now to the drawings (FIGS. 1-3B), the tool of the present invention includes a flat handle 12, which can also be referred to as an elongate member. The wrench or tool 10 has a generally flat bodied handle and made of high density polymer or suitable material. The bushing aperture or opening 14 fits snugly over the barrel bushing of the 1911. The Recoil Spring Plug/Guide Rod Plug Catcher or opening 16 captivates the recoil spring plug/guide rod plug when released by rotation of the barrel bushing. The Plunger 18 may be biased and utilized in assembly to safely depress the recoil spring plug/guide rod plug into its proper position to allow the barrel bushing to be turned to its proper position. The Plunger Spring 20 keeps the Plunger 18 in position or biased so that: 1) the cavity remains free to "catch" the recoil spring plug/guide rod plug, and 2) to give the end user a "tactile" feel in the reassembly process. The Thumb Dimple 22 allows a more comfortable and secure grasp of the tool. The Recessed Hex Tool Socket 24 is utilized for standard and/or specialized hex bits to be inserted for further disassembly of the 1911.

In accordance with example implementations at least two openings 14 and 16 can extend between opposing planar surfaces 30 and 32 of member 12. As described, opening 14 can be configured to engage a bushing and the other of the two openings 16 can be configured to receive a recoil spring of a fire arm. These two openings overlap at 40 and can be lateral to one another. Opening 14 can be defined by a pair of opposing sidewalls 50 as well as a curved sidewall 52.

Opening 16 can be operatively aligned with a tube 60 that extends normally from one of the opposing planar surfaces 30 or 32. An interior diameter of the tube 60 can be equal to a diameter of opening 16.

Dis-Assembly and Assembly Procedure

This tool, as previously mentioned, is intended to be used with 1911 pattern handguns. Although there are various manufacturers and variants of this model, the 1911 Bushing Wrench And Recoil Spring Plug Catcher Tool is suitable for use in all of them. The following is a description of the inherent design of the 1911 as pertains to this tool.

Figure 3A:
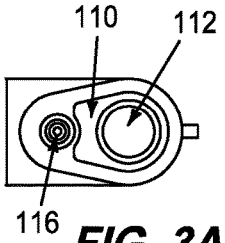
FIG. 3A is a depiction of a portion of a firearm.
Figure 1:
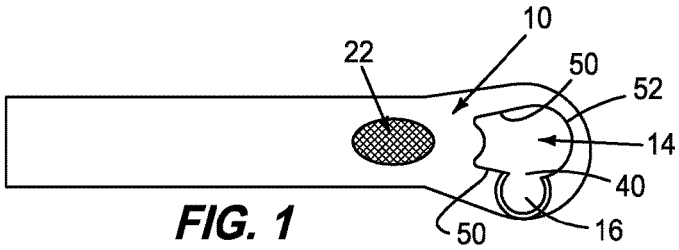
FIG. 1 is a view of a firearm tool according to an embodiment of the disclosure.
Figure 2:
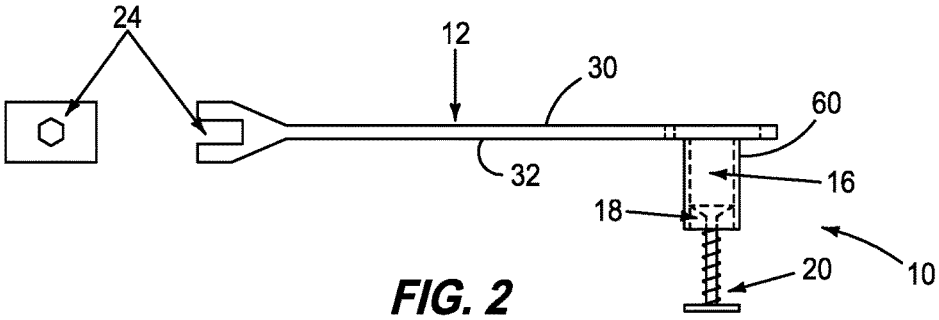
FIG. 2 is-another view of the firearm tool of FIG. 1 according to an embodiment of the disclosure.

Referring to FIGS. 3A and 3B, the barrel of the representative 1911 handgun is generally represented by the numeral 100. A bushing 110 is at the forward end of the barrel. Below the bushing is a hole that extends parallel to the barrel having a spring 114 retained by a recoil spring plug/guide rod plug 116. To clean or repair the firearm, the barrel 100, the barrel bushing 110 must first be removed. The tool of the present invention is used for this purpose and the procedures are further described below.

For dis-assembly, when fitted over the bushing 110 and the tool is rotated clockwise in order to disengage the recoil spring plug/guide rod plug 116, the recoil spring plug/guide rod plug 116 ejects into the cavity of the Plunger 18. The recoil spring plug/guide rod plug 116 can now be safely removed from the recoil spring 114 and set aside. To reassemble, the recoil spring plug/guide rod plug 116 is inserted into the cavity of the Plunger 18, while the wrench or tool 10 is fitted over the barrel bushing 110. The Plunger 18 is now depressed, pushing the recoil spring plug/guide rod plug 116 into the firearm, while compressing the recoil spring 114 enough so that it will not interfere with the counterclockwise turning of the barrel bushing 110. While keeping the plunger 18 depressed, the wrench or tool 10 is rotated counterclockwise unto the recoil spring plug/guide rod plug 116 "snaps" into place, which is tactility felt by the thumb which is depressing the Plunger 18. At this point, reassembly of the barrel bushing 110—recoil spring plug/guide rod plug 116 assembly has been accomplished.

The invention claimed is:

1. A firearm tool comprising:

an elongate member extending from a first end to a second end and defining opposing planar surfaces;

at least two receptacles defined about the first end of the elongate member and extending between the opposing planar surfaces;

one of the two receptacles configured to engage a bushing;

another of the two receptacles configured to receive a recoil spring, wherein the at least two receptacles overlap; and a tube extending normally from the elongate member, the tube configured to receive the recoil spring.

2. The firearm tool of claim 1 wherein the receptacles are lateral to one another.

3. The firearm tool of claim 1 wherein the interior diameter of the tube is equal to the diameter of the other of the two receptacles.

4. The firearm tool of claim 1 further comprising a biased plunger within the tube.

5. The firearm tool of claim 1 wherein the one of the two receptacles is defined by a pair of opposing sidewalls.

6. The firearm tool of claim 1 wherein the one of the receptacles is defined by a curved sidewall portion.

7. The firearm tool of claim 1 further comprising a dimple recessed within the member and proximate the at least two openings.

8. The firearm tool of claim 1 further comprising a recess extending longitudinally with the member within the second end of the member.

9. The firearm tool of claim 8 wherein the recess defines planar walls configured to receive a hex tool.

* * * * *